US005407095A

United States Patent [19]

Alli

[11] Patent Number: 5,407,095

[45] Date of Patent: Apr. 18, 1995

[54] STAGED RAMP DISCHARGE SYSTEM FOR VENDING MACHINE

[75] Inventor: Safdar Alli, Markham, Canada

[73] Assignee: Opal Manufacturing (1989) Ltd., Downsview, Canada

[21] Appl. No.: 250,611

[22] Filed: May 27, 1994

[51] Int. Cl.[6] ..... B65H 3/00

[52] U.S. Cl. ..... 221/194; 193/32; 193/2 R; 221/312 R

[58] Field of Search ..... 193/32, 8, 40, 2 R; 221/191, 193, 194–196, 312 R

[56] References Cited

U.S. PATENT DOCUMENTS

| | | | |
|---|---|---|---|
| 1,061,151 | 5/1913 | White | 193/32 |
| 1,525,880 | 2/1925 | Mueller | 193/32 |
| 3,612,515 | 10/1971 | Bergeson | 193/2 R |
| 4,180,183 | 12/1979 | Muller | 221/194 |
| 4,997,106 | 3/1991 | Rockola | 221/195 |

*Primary Examiner*—H. Grant Skaggs

*Attorney, Agent, or Firm*—H. Jay Spiegel

[57] ABSTRACT

An improved staged ramp discharge system for vending machine includes a staged ramp discharge system including an upper chute in an upper chamber which leads to a lower chute in a lower chamber. An upper wall of the lower chamber defines the transition from the upper chamber to the lower chamber with this upper wall being solid and impervious. The upper chamber has a first lower wall separating the upper chamber from the lower chamber with the first lower wall having a lower surface slightly spaced above the surface of the upper chute to provide a horizontal slot through which articles which are being dispensed may slide. The lower chamber has a second lower wall also having a lower surface slightly spaced above the surface of the lower chute to provide a horizontal slot which is sized to permit an article which is being dispensed to slide therethrough. This configuration is designed to preclude tampering.

6 Claims, 3 Drawing Sheets

STAGED RAMP DISCHARGE SYSTEM FOR VENDING MACHINE

BACKGROUND OF THE INVENTION

The present invention relates to an improved staged ramp discharge system for vending machine. Vending machines which dispense a variety of articles responsive to payment of the required amount are well known. An example of such a vending machine is disclosed in U.S. Pat. No. 4,180,183 to Muller. In the Muller device, each article dispensing unit drops a dispensed article into a chute which conveys the article to a location where a door may be opened to allow the purchaser to grasp the article. FIG. 5 of the Muller Patent is reproduced herein as FIG. 1 and appropriately labelled "PRIOR ART". In the FIGURE, it may be clearly understood that the Muller chute includes an upper slide portion 54 and a lower slide portion 56 which are generally parallel to one another but vertically staggered with a false opening 60 being provided therebetween and with the lower portion of the upper slide portion 54 being serrated at 58.

As disclosed by Muller, the Muller mechanism is designed to prevent tampering. In this regard, Muller states the following at column 5 beginning at line 1:

> "If however such a tamperer should open the door 26 only part way, such that for example the closure 70 may not be fully shut, then in some circumstances it may be possible to insert a thin probe such as a piece of wire between slide 56 and lower edge 74. In this case however such a probe will be caught by the upper slide 54, and it will simply pass through the false opening 60 so that again, tampering with the actual contents of the vending machine is virtually impossible."

Applicant has found that while such tampering is difficult, it is, by no means, impossible. The false opening 60 does not preclude one from using a thin wire which may be slightly bent to bypass the false opening 60, slide up the upper slide portion 54 and under the tipping rod 62 and thence enter the article dispenser to cause dispensing of its contents without payment.

The entirety of the disclosure of the Muller Patent is hereby incorporated by reference herein.

Accordingly, a need has developed for a discharge system which is simple to manufacture and is more effective than the Muller system in preventing tampering. It is with these aspects in mind that the present invention was developed.

SUMMARY OF THE INVENTION

The present invention relates to an improved staged ramp discharge system for vending machine. The present invention includes the following interrelated objects, aspects and features:

(A) In a first aspect, the present invention includes a staged ramp discharge system including an upper chute in an upper chamber which leads to a lower chute in a lower chamber. An upper wall of the lower chamber defines the transition from the upper chamber to the lower chamber with this upper wall being solid and impervious.

(B) The upper chamber has a first lower wall separating the upper chamber from the lower chamber with the first lower wall having a lower surface slightly spaced above the surface of the upper chute to provide a horizontal slot through which articles which are being dispensed may slide.

(C) The lower chamber has a second lower wall also having a lower surface slightly spaced above the surface of the lower chute to provide a horizontal slot which is sized to permit an article which is being dispensed to slide therethrough.

(D) An article which is being dispensed by the associated article dispenser of the vending machine is dropped from the article dispenser into the upper chamber, whereupon the article slides down the upper chute, under the first lower wall of the upper chamber, drops down adjacent the upper wall of the lower chamber and thence into the lower chamber, slides down the lower chute, under the second lower wall of the lower chamber and thence out of the vending machine.

(E) If desired, an upwardly facing lip may be provided at the end of the lower chute beyond the lower wall of the lower chute to catch the article so that it does not fall on an adjacent floor surface.

(F) The present invention is specifically devised to make tampering with the vending machine virtually impossible. The height of the upper wall of the lower chamber combined with the narrow nature of the slots defined under the respective lower walls of the upper and lower chambers makes it virtually impossible for a criminal to devise a wire which can traverse the two slots, the upper wall of the lower chamber and engage the article dispenser. In this regard, were such a wire to be devised, given the vertical spacing of the lower extremity of the article dispenser with respect to the upper end of the upper chute, such a wire would pass harmlessly laterally under the article dispenser.

Accordingly, it is a first object of the present invention to provide an improved staged ramp discharge system for a vending machine.

It is a further object of the present invention to provide such a device including upper and lower chambers including upper and lower chutes.

It is a yet further object of the present invention to provide such a device including no moving parts and including a solid, impervious wall between the upper and lower chambers designed to prevent tampering.

It is a still further object of the present invention to provide the upper chamber with a first lower wall defining with the upper chute a slot.

It is a still further object of the present invention to provide such a device with the lower chamber having a second lower wall having a lower surface defining with the lower chute a further slot.

These and other objects, aspects and features of the present invention will be better understood from the following detailed description of the preferred embodiment when read in conjunction with the appended drawing FIGURES.

SPECIFIC DESCRIPTION OF THE PREFERRED EMBODIMENT

Figure 2:
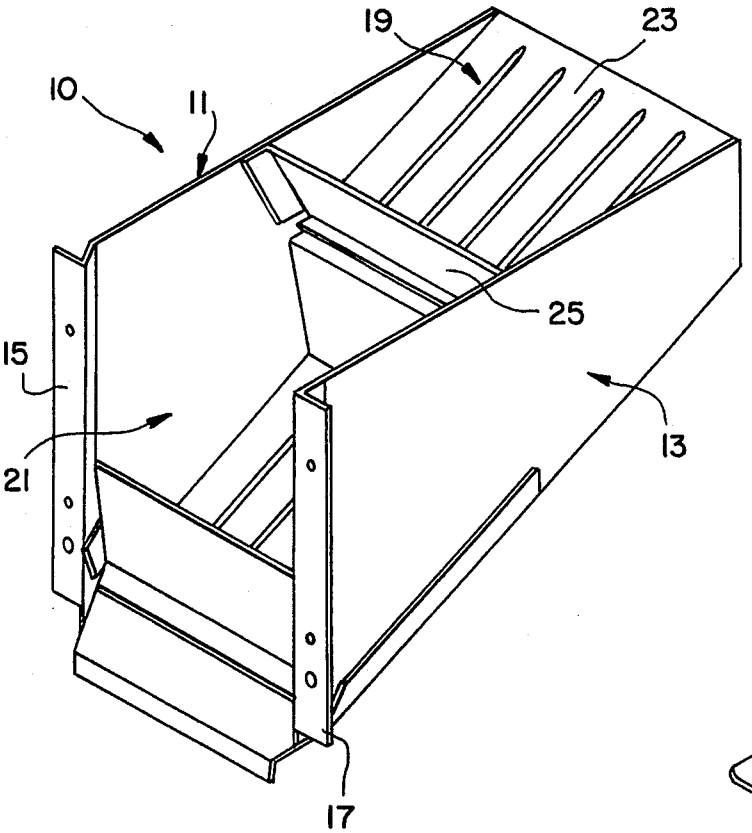
FIG. 2 shows a front perspective view of the present invention.

With reference to FIGS. 2–5, the present invention is generally designated by the reference numeral 10 and with particular reference to FIG. 2 is seen to include side walls 11 and 13 having respective front bracket portions 15 and 17 which are provided to permit easy attachment of the inventive device 10 to a vending machine in a similar manner to the manner of installation of the article delivery chute of the Muller Patent.

As seen in FIGS. 2–5, the inventive device 10 includes an upper chamber 19 and a lower chamber 21. The upper chamber 19 includes an upper chute 23, portions of the side walls 11 and 13 and a first lower wall 25 defining the lowermost extent of the upper chamber 19.

Figure 1:
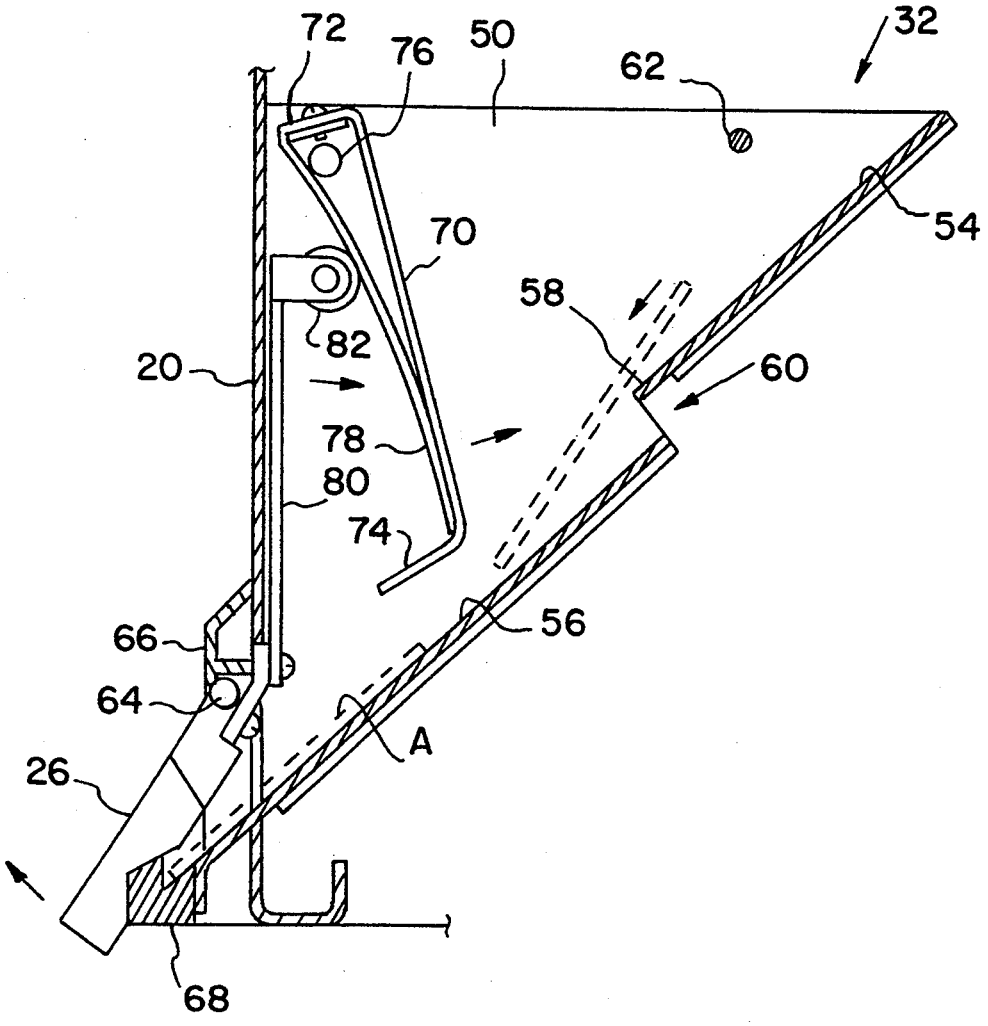
FIG. 1 PRIOR ART
FIG. 1 comprises a cross-sectional view corresponding to FIG. 5 of U.S. Pat. No. 4,180,183.
Figure 3:
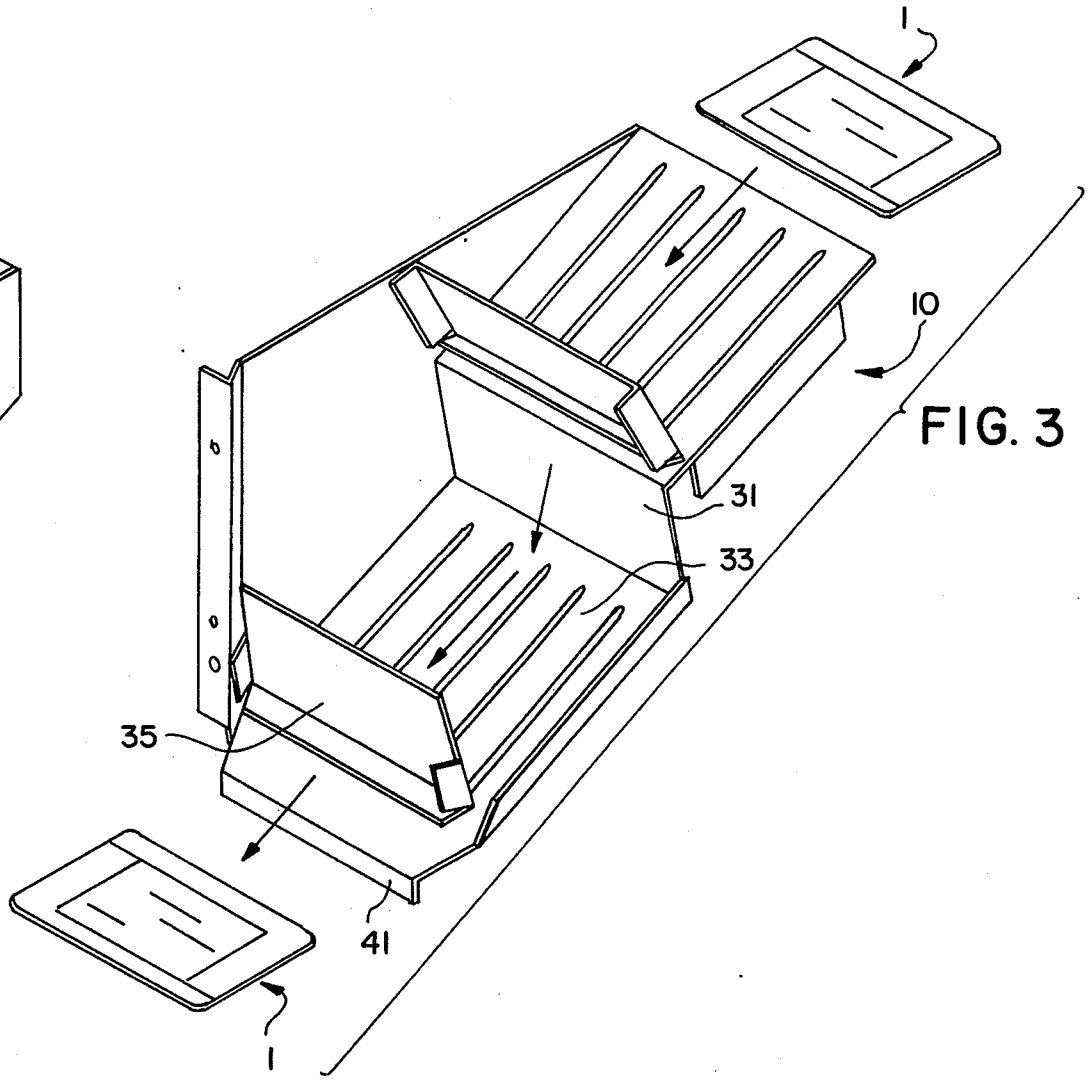
FIG. 3 shows a further front perspective view with portions removed to show detail.
Figure 5:
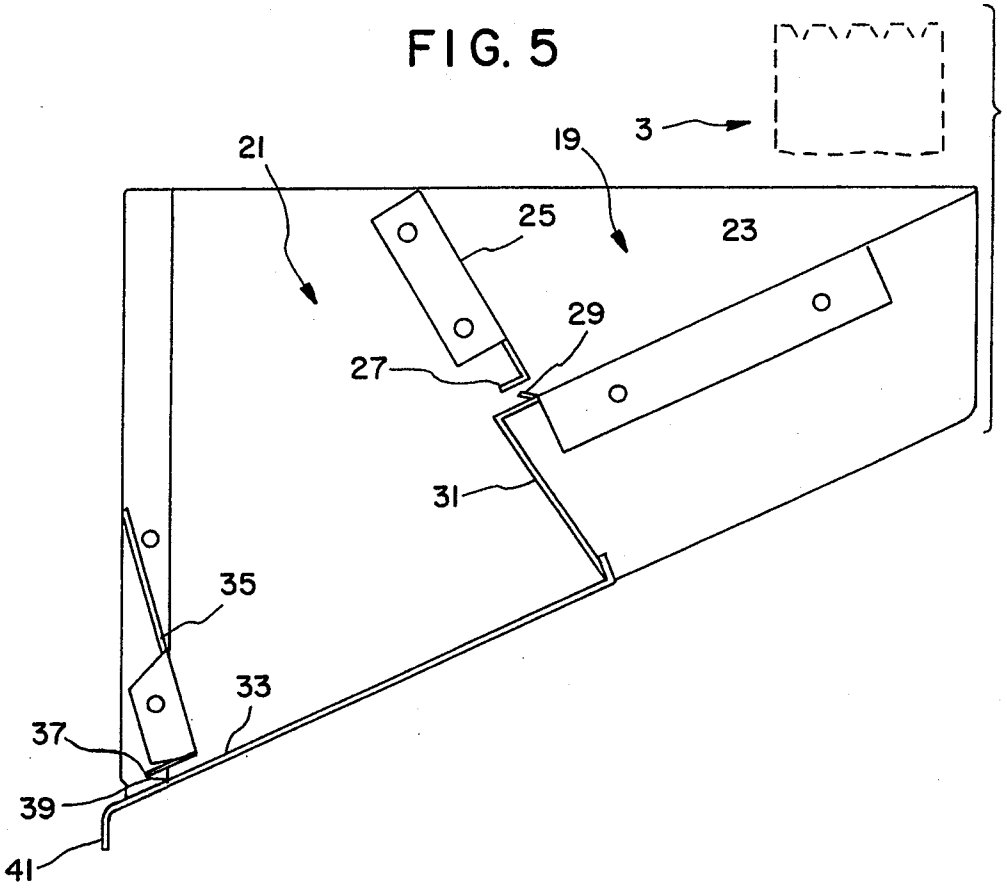
FIG. 5 shows a side view of the view of FIG. 3, with portions broken away to show detail.
Figure 4:
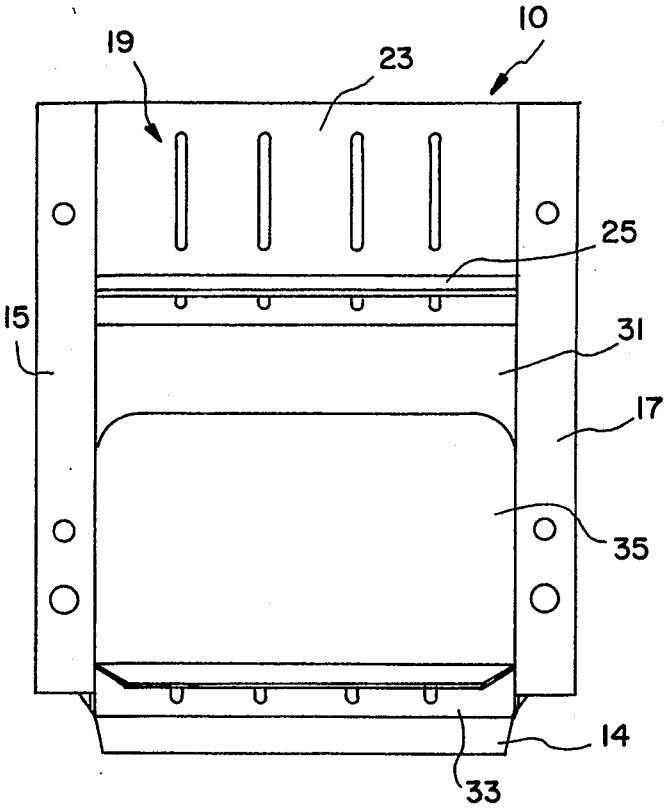
FIG. 4 shows a front view of the present invention.

The first lower wall 25, as best seen in FIG. 5, has a lower surface 27 defining the lowermost extent of the first lower wall 25 and defining a slot of narrow configuration permitting an article such as the article 1 illustrated in FIG. 3 to closely slide thereunder.

The lower chamber 21 is defined by an upper, solid, impervious wall 31 which extends downwardly from the lower extent of the upper chute 23 and straight downwardly until it terminates at the uppermost extent of the lower chute 33. The lower chamber 21 is defined by the lower chute 33, portions of the side walls 11 and 13, the wall 31 and a second lower wall 35 which, as best seen in FIG. 5, has a lower surface 37 slightly spaced above the lower chute 33 to define, therebetween, a narrow slot 39 sized and configured to allow the article 1, seen in FIG. 3, to closely slide thereunder.

The lower chute 33 terminates downwardly beyond the further lower wall 35 in a downwardly depending lip 41 which, in the embodiment shown, is specifically designed to provide no resistance to the sliding of the article 1 therepast and into the hand of the purchaser. If desired, one may provide an upwardly extending lip instead of the lip 41 which would stop the sliding of the article 1 to prevent it from falling on an adjacent floor surface.

In the operation of the present invention, the inventive device 10 is installed within a vending machine such as the vending machine disclosed in United States Patent 4,180,183 and in a manner similar to the manner of installation of the chute 32 as disclosed therein. When a user inserts payment into the appropriate slot of the associated vending machine, thereby causing an article to be dispensed from the article dispenser thereof, the article so dispensed will fall onto the upper chute 23, will slide downwardly through the force of gravity, through the slot 29 and will thence drop adjacent the wall 31 onto the lower chute 33 whereupon, through the force of gravity, the article will continue to slide downwardly, through the slot 39 and into the hand of the purchaser.

As explained hereinabove, the specific design of the present invention is particularly devised to preclude tampering. Thus, with particular reference to FIGS. 3 and 5, it is seen that it would be extremely difficult to devise a bent wire which could allow successful tampering with the article dispenser shown in phantom and referred to by reference numeral 3 in FIG. 5 and shown in the position of alignment and elevation with respect to the inventive device 10 in the environment of intended use. As should be understood, any wire bent so that it is able to slide through the slot 39, up the wall 31, and through the slot 29 would necessarily pass harmlessly below the article dispenser 3 and would pose no threat to the dispensing of articles without payment.

The inventive device 10 has no moving parts and thus requires no maintenance such as would be the case in prior art chute mechanisms including that which is disclosed in U.S. Pat. No. 4,180,183.

As such, an invention has been disclosed in terms of a preferred embodiment thereof which fulfills each and every one of the objects of the present invention as set forth hereinabove and provides a new and useful improved staged ramp discharge system for vending machine of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved staged ramp discharge system for a vending machine, comprising:

a) a body having side walls;

b) an upper chamber defined between said walls and including an upper chute terminating at a first narrow horizontal slot;

c) a lower chamber defined between said side walls and including a lower chute terminating at a second narrow horizontal slot, said lower chamber having an upper solid impervious wall extending generally upwardly from and with respect to said lower chute, said upper solid impervious wall having an upper termination adjacent said first slot and beyond said first slot with respect to said first chute.

2. The system of claim 1, wherein said upper solid impervious wall extends between and in engagement with said side walls.

3. The system of claim 1, wherein said first slot is defined by a first lower wall extending between said side walls and having a lower surface spaced from said first chute.

4. The system of claim 3, wherein said second slot is defined by a second lower wall extending between said side walls and having a further lower surface spaced from said second chute.

5. The system of claim 4, wherein each of said lower surface and further lower surface includes a bent portion of the first lower wall and second lower wall, respectively.

6. The system of claim 1, further including an exit ramp attached to said lower chute and having a downwardly depending lip.

* * * * *